United States Patent [19]

Reynolds et al.

[11] 4,387,728

[45] Jun. 14, 1983

[54] CIGARETTE FILTER

[75] Inventors: Martin L. Reynolds; Robert R. Johnson, both of Louisville, Ky.

[73] Assignee: Brown & Williamson Tobacco Corporation, Louisville, Ky.

[21] Appl. No.: 245,428

[22] Filed: Mar. 19, 1981

[51] Int. Cl.[3] ..... A24D 3/04; A24D 3/18

[52] U.S. Cl. ..... 131/336; 131/361; 131/362; 131/365; 131/94; 131/339

[58] Field of Search ..... 131/361, 362, 339, 365, 131/340, 336, 340, 341, 338, 94

[56] References Cited

U.S. PATENT DOCUMENTS 3,910,288 10/1975 Hammersmith et al. ..... 131/340

4,256,122 3/1981 Johnson ..... 131/339

*Primary Examiner*—V. Millin

*Attorney, Agent, or Firm*—Charles G. Lamb

[57] ABSTRACT

A filter for a cigarette includes a porous filter rod circumscribed by a non-porous wrapper wherein the filter rod with the non-porous wrapper therearound is provided with grooves extending from one end thereof a preselected distance longitudinally therealong. The grooves are open to the atmosphere and may be oriented to extend to the mouth end of the filter when connected to a cigarette, to the tobacco end of the filter when connected to the cigarette, or non-connecting grooves which extend from each end of the filter element a preselected distance therealong.

5 Claims, 3 Drawing Figures

CIGARETTE FILTER

BACKGROUND OF THE INVENTION

1. Field of the Invention

This invention relates to filters for cigarettes. In one aspect it relates to a filter with novel ventilating means therein. In another aspect the invention relates to a filter cigarette having flow directing grooves therein for directing ventilating air either to the tobacco end of the filter or to the mouth end of the filter or a combination thereof.

2. Description of the Prior Art

It is well known in the art to add filters to cigarettes wherein the filters are provided with ventilating means to bring in ambient air into the filter to dilute the smoke stream. The dilution of the smoke stream reduces the quantity of smoke particulates as well as gas phase components which are delivered to the mouth of the smoker. A number of means have been proposed and are utilized for introducing ventilating air into the cigarette. For example, the wrapper for the tobacco in a cigarette can be made from a porous material which allows for introduction of air along the entire length of the cigarette where it mixed with the smoke stream passing therethrough thereby diluting the smoke in the stream. Also, the cigarette wrapper may be perforated at selected locations along the length of the cigarette which provides ports for the cigarette through which ventilating air enters. Even further, it is known to perforate the wrapper of the filter on the filter end of the cigarette to allow for ventilating air to enter the filter for dilution of the smoke stream. There have also been a number of suggestions for incorporating grooves within the filter plug for the cigarette in order to facilitate the addition of ventilating air into the smoke stream.

For example, U.S. Pat. No. 3,596,663 relates to a tobacco smoke filter provided with a corrugated porous plug wrap surrounding a filter element which is circumscribed by a tipping paper having flow-through perforations therein whereby ventilating air enters directly into the filter element or progresses down the grooves to the smoker's mouth. Other patents which relate to cigarette filters having grooves circumscribing the filter element for the introduction of ventilating air into the filtering end of the filter cigarette include U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; West German Pat. No. 2,302,677; British Pat. No. 1,414,745; British Pat. No. 1,360,612; British Pat. No. 1,360,611; and, U.S. Pat. No. 3,910,288, the aforementioned British patents being directed to non-wrapped acetate filters. Furthermore, in co-pending application, Ser. No. 029,230, filed Apr. 11, 1979, a filter for a cigarette having ventilating air grooves-embedded into the filter element is described. In this application, the filter element is circumscribed by non-porous plug wrap wherein a plurality of grooves are embedded longitudinally into the plug wrap and the filter element; and, the plug wrap and filter element are circumscribed by tipping material having ventilating air openings therein.

SUMMARY OF THE INVENTION

The present invention provides a cigarette filter for lowering tar predominantly by ventilation instead of filtration. The present invention further provides a filter ventilation system for a cigarette utilizing grooves in the filter plug extending a preselected distance along the filter plug to one end of the filter. The present invention also provides a grooved filter with a non-porous plug wrap.

In co-pending application Ser. No. 029,230, filed Apr. 11, 1979, the flow of ventilating air is controlled by the number of perforations in the tipping paper in flow-through communication with the grooves as well as the cross-sectional area of the perforations. It has now been found that a filter can be made wherein the ventilating air flow is determined by the size, length, and depth of the grooves in the filter plug and tipping paper is omitted.

Various other features of the present invention will become obvious to those skilled in the art upon reading the disclosure set forth hereinafter.

More particularly, the present invention provides a filter for a cigarette comprising a porous filter rod of cylindrical configuration and a non-porous wrapper extending longitudinally of and circumscribing the rod leaving flow-through opposed ends of the rod, the wrapper and the rod having a plurality of longitudinally extending grooves circumferentially spaced therearound, the grooves extending from at least one end a preselected distance therealong.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
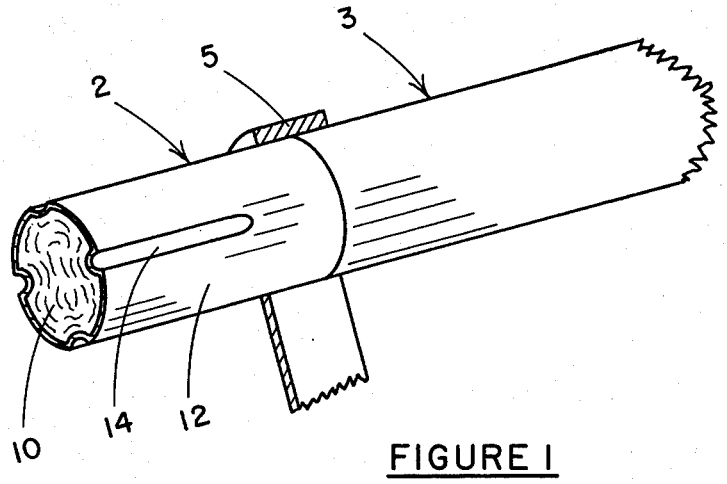
FIG. 1 is a perspective view of a preferred filter plug of the present invention attached to a cigarette with ventilating air grooves in the filter plug directed away from the cigarette.
Figure 2:
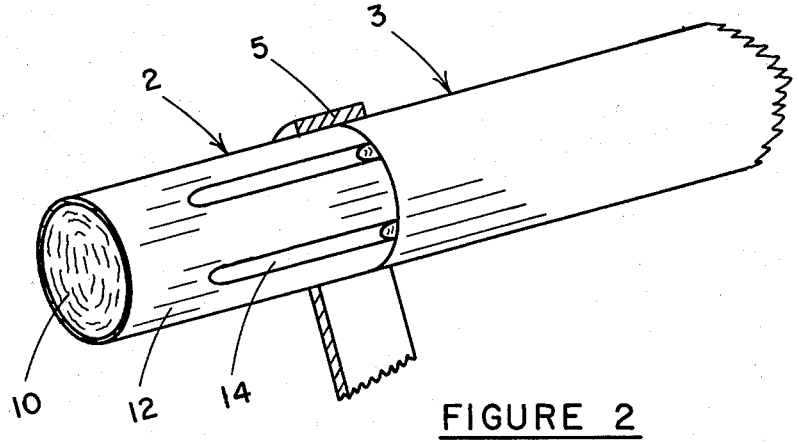
FIG. 2 is a perspective view of the filter plug of FIG. 1 attached to a cigarette wherein the filter plug is turned for ventilating air grooves to be directed toward the cigarette; and, FIG. 3 is a perspective view of another preferred filter plug of the present invention attached to a cigarette wherein the filter plug is provided with ventilating air grooves at each end.

In FIGS. 1 and 2, a filter plug 2 of the present invention is shown. This filter plug 2 comprises a cellulose acetate filter element 10 or any other filter made from fibrous or foamed materials for tobacco smoke which may be known in the art circumscribed by a non-porous wrapper 12. It is realized that in the use of the term "non-porous wrapper", this includes non-porous outer surfaces of foamed material which are integral with the filter element as well as non-porous wrapping material which is not integral with the filter element. The filter plug 2 is provided with a plurality of grooves 14 therein extending longitudinally therealong. The filter plugs 2 are generally prepared by taking a standard filter rod of cellulose acetate or the like, wrapping the rod with a non-porous wrapping material, then subjecting the wrapped filter rod to a mold or other treating means designed for putting appropriate grooves therein. One such method is known as a heat molding technique, which is well known in the art.

In FIG. 1, the filter plug 2 is attached to a cigarette or tobacco column 3 at the non-grooved end by a small strip of material 5. It is realized that the means for attaching the filter plug 2 may take other forms without departing from the scope and spirit of this invention, the only consideration being that the attaching means does not interfere with the intake or flow of ventilating air. In use, ventilating air enters the grooves 14 upon inhalation by a smoker and travels down the grooves 14 towards the smoker's mouth. The number of grooves, depth of the grooves, groove positioning and length will be determined for the amount of ventilating air desired.

In FIG. 2 the filter plug 2 is attached to a cigarette or tobacco column 3 at the grooved end by a small strip of material 5 as in FIG. 1. However, in use, ventilating air enters the grooves 14 upon inhalation by a smoker and travels down the grooves 14 toward the tobacco column 3.

Figure 3:
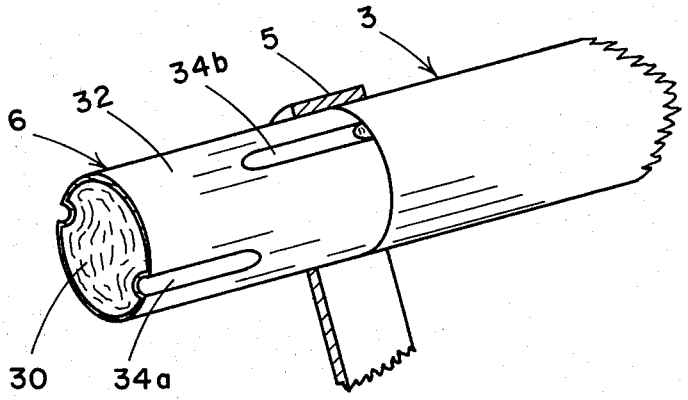

FIG. 3 shows a filter plug 6 which is comprised of a filter element 30 which may be cellulose acetate, or any other filter element known in the art, circumscribed by a non-porous wrapper 32 and includes a plurality of grooves 34*a* and 34*b* extending longitudinally from each end of the plug a preselected distance therealong. In the method of preparing a filter plug 6, the same procedure is utilized as mentioned hereinbefore in discussion of the preparation of filter plugs in FIGS. 1 and 2. However, in use of the filter plug 6 of FIG. 3, the filter plug 6 is attached to a cigarette or tobacco column 3 with a small strip of material 5 as in FIGS. 1 and 2. In use, ventilating air travels into the smoker's mouth through grooves 34*a* and travels down the filter plug 6 into the tobacco column 3 through grooves 34*b* simultaneously therewith.

It will be realized that various changes may be made to the specific embodiments shown and described without departing from the principles of the present invention.

What is claimed is:

1. In a cigarette having a filter attached thereto wherein said filter and said cigarette are attached by a small strip of material, comprising: said filter being a porous rod of cylindrical configuration;

a smoke impervious wrapper extending longitudinally along said rod from at least one end thereof and circumscribing said rod leaving flow-through opposed ends of said rod, said wrapper having a plurality of longitudinally extending grooves circumferentially spaced therearound embedded into the filter rod and that portion of the wrapper defining the grooves remaining smoke impervious, said grooves being open ended at and extending from at least one of said ends a distance less than the length of the filter rod, the improvement being characterized in that for lowering the "tar" by ventilation the filter is connected with a cigarette or tobacco column only with said small strip of material, when attached to said filter, said strip has a width less than the distance between the groove and the tobacco column whereby said strip does not interfere with ventilating air flowing along said groove when in use.

2. The filter of claim 1 in combination with the cigarette, said grooves of said filter being in flow communication with said cigarette.

3. The filter of claim 1 in combination with the cigarette, said grooves of said filter being in flow communication with the smoker's mouth.

4. The filter of claim 1, said grooves extending from both ends a preselected distance therealong, said grooves being non-connectable.

5. The filter of claim 1, said smoke impervious wrapper being integral with said porous filter rod.

* * * * *